United States Patent [19]

Baum

[11] Patent Number: 4,972,560

[45] Date of Patent: Nov. 27, 1990

[54] APPARATUS FOR A KNITTED FABRIC TENTER FRAME

[75] Inventor: Gottfried Baum, Erkelenz, Fed. Rep. of Germany

[73] Assignee: A. Monforts GmbH & Co., Monchen-Gladbach, Fed. Rep. of Germany

[21] Appl. No.: 256,713

[22] Filed: Oct. 12, 1988

[30] Foreign Application Priority Data

Oct. 12, 1987 [DE] Fed. Rep. of Germany ..... 3734432

[51] Int. Cl.[5] ..... D06C 3/02

[52] U.S. Cl. ..... 26/96; 26/78; 26/76; 26/86

[58] Field of Search ..... 26/96, 86, 92, 77, 78

[56] References Cited

U.S. PATENT DOCUMENTS

| | | | |
|---|---|---|---|
| 3,637,121 | 1/1972 | Alexeff | 26/77 |
| 3,666,156 | 5/1972 | Becker | 26/86 |
| 3,936,915 | 2/1976 | Becker | 26/86 |

FOREIGN PATENT DOCUMENTS

| | | | |
|---|---|---|---|
| 90046 | 1/1897 | Fed. Rep. of Germany . | |
| 2204129 | 1/1972 | Fed. Rep. of Germany | 26/77 |
| 2208756 | 8/1973 | Fed. Rep. of Germany . | |
| 3205343 | 9/1983 | Fed. Rep. of Germany . | |
| 3417030 | 11/1985 | Fed. Rep. of Germany . | |
| 1416788 | 9/1965 | France | 26/86 |

*Primary Examiner*—Werner H. Schroeder
*Assistant Examiner*—Bradley Kurtz DeSandro
*Attorney, Agent, or Firm*—Shefte, Pinckney & Sawyer

[57] ABSTRACT

An apparatus for a tenter frame feeds a fabric web to the nip region of vertical pins and cooperating rollers of a pair of endless belt assemblies which transport the web through a drying chamber. The apparatus includes a guide member which guides the web into the nip at a relatively steep angle, preferably in the range of +° to 60°. The guide member can be supported on a pair of swivel supports, each of the swivel supports being movably supported on one of the endless belt assemblies. Additionally the guide member can be a roller rotatable about its axial length which can be rotated in synchronization with the feed of the web.

3 Claims, 1 Drawing Sheet

Fig.1
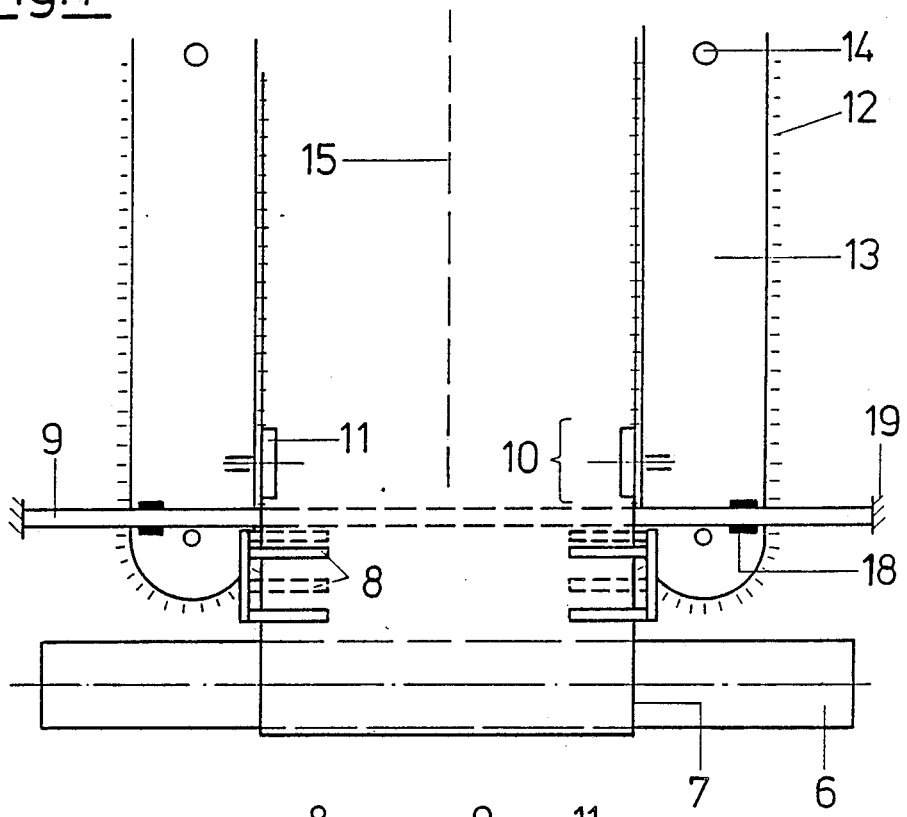
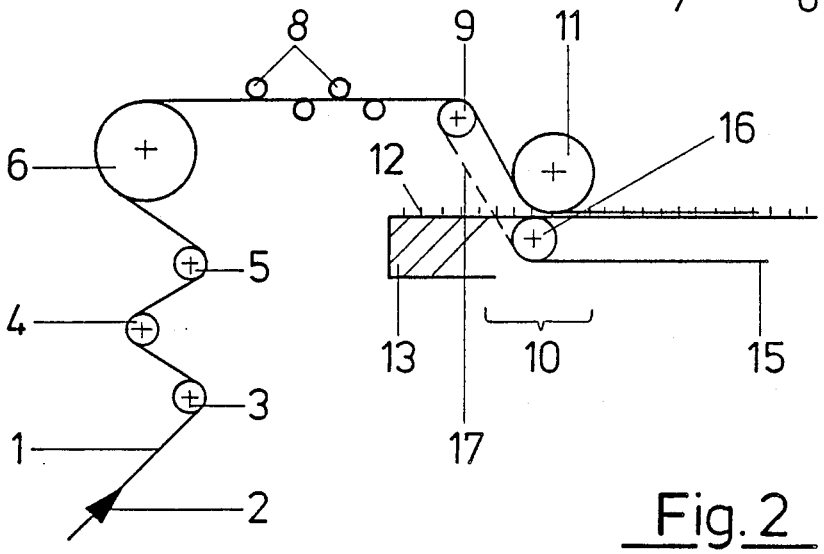
Fig.2

APPARATUS FOR A KNITTED FABRIC TENTER FRAME

BACKGROUND OF THE INVENTION

The present invention relates to an apparatus for a tenter frame for drying a web of knitted material, the tenter frame being of the type having a feed roller for feeding the web along a feed path through a pair of opposed finger assemblies for smoothing the edges of the fabric to a pair of endless belts having vertical needles for securing the web during transport through a drying chamber.

In the handling of knitted fabric in a tenter frame, a fabric web is fed along a path to ultimately pass through a drying chamber in which the web is dried. To ensure that the web is of uniform width and generally planar during its travel through the drying chamber, the lengthwise edges of the web are pressed onto a plurality of uniformly spaced, upright pins mounted on a pair of spaced apart endless belt assemblies which extend into and through the drying chamber. The assemblies on which the respective rollers and endless belts forming the nip are mounted are pivotably adjustable to accommodate changes in web width, which pivoting causes relative movement of the assemblies with respect to the feed roller. To ensure that the web maintains its width as it is fed into the nip in which a pair of spaced pin rollers press the web border onto the pins, a series of opposed fingers smooth the respective lengthwise borders of the web. The pair of endless belts then transport the web in generally flat disposition through the drying chamber.

The tenter frame is often provided with a support belt of the endless belt type running parallel to the feed path and positioned just below the web of knitted material for supporting the web during its travel so that sagging, which is detrimental, is avoided. The support belt extends from the feed roller to a position adjacent the nip. The support belt is driven by the feed roller so the belt travels in sychronization with the feed of the web.

Since the support belt is driven by the feed roller, it travels in synchronization with the rate of feed of the web into the drying chamber. However, problems arise in maintaining the synchronization of the support belt with the web since the distance between the feed roller and the nip region varies as the endless belt assemblies are pivoted to accommodate changes in the width of the web and this causes corresponding changes in the tension of the support belt since it is coupled to the feed roller. Additionally, the relative distance between the feed roller and the nip may change as the endless belt assemblies expand due to heat during operation and this change of position, in turn, creates a change in the distance between the feed roller and the nip regions. Accordingly, practical difficulties are encountered in maintaining the support belt at a suitable tension while driving the belt in synchronization with the rate of feed of the web.

SUMMARY OF THE INVENTION

The present invention provides an apparatus for feeding a web of fabric to the nip formed by the pin rollers and pins of a transport assembly of a tenter frame which transports the web through a drying chamber. Advantageously, since the apparatus of the present invention eliminates the need for a support belt to support the web between the feed roller and the nip region, the apparatus eliminates the monitoring previously required in the use of the support belt of the relative distance between the feed roller and the nip region.

Briefly described, one preferred embodiment of the apparatus of the present invention includes an apparatus in a tenter frame for drying a web of textile fabric fed along a feed path by a feed roller through edge straightening fingers to a pair of spaced apart belt assemblies with endless belts having vertical pins on which the edges of the nip are impaled by rollers cooperating therewith at a nip below a height of the edge straightening fingers, the apparatus including means for guiding the traveling web at a relatively steep angle into the nip including a guide member positioned generally transversely to the feed path between the edge straightening fingers and the nip and at substantially the same height as the edge straightening fingers.

Preferably, the guide member of the apparatus is supported on a pair of swivel supports, each of the swivel supports being movably supported on one of the endless belt assemblies.

In one preferred embodiment of the apparatus, the guide member is a roller rotatable about its axial length and the guide means includes means for rotating the roller in synchronization with the feed of the web.

Preferably, the guide member is positioned relative to the nip such that the web enters the nip at an angle in the range of 30° to 60°.

BRIEF DESCRIPTION OF THE DRAWINGS

FIG. 1 is a schematic representation, as viewed from the top, of the guide assembly of the present invention and the adjacent elements of the tenter frame on which it is installed; and FIG. 2 is a schematic representation, as viewed from the side, of the guide assembly of the present invention and the adjacent elements of the tenter frame.

DETAILED DESCRIPTION OF PREFERRED EMBODIMENTS

In FIG. 1 and 2, the guide assembly of the present invention is illustrated in its installed position on a tenter frame. The tenter frame includes a number of elements for feeding a web of material 1 such as, for example, knitted textile fabric, along a feed path indicated by the arrow 2 including an intake roller 3, an expander roller 4, directional roller 5 and a feed roller 6. The feed roller 6 is driven by a drive mechanism (not shown) and it propels the web 1 along the feed path through a series of straightening fingers 8 positioned on each side of the web which smooth the respective longitudinal edge 7 of the web 1 as the web passes therethrough, thereby preparing the edges for insertion onto pins, as described below, and ensuring that the web maintains a generally constant width.

The guide assembly of the present invention includes a guide member 9 oriented transversely to the direction of feed of the web 1 and positioned downstream of the fingers 8 at operably the same height as the finger 8.

The guide member 9 is also positioned relative to a pair of nips 10 defined by a pair of pin rollers 11 cooperating with a plurality of vertically oriented pins 12 spaced along a pair of endless belts of belt assemblies 13. Each belt assembly 13 is pivotable about a respective vertical pivot 14. Each pin roller 11 presses on the top of a respective edge 7 to push the pin onto the underlying pins 12, whereby the web 1 is held in generally flat disposition at a fixed width as it is transported through the drying chamber (not shown) by travel of the endless belts of the belt assemblies 13. The guide member 9 is positioned relative to the nips 10 such that the orientation of the web 1 to the nips 10 after it passes over the guide member 9 is a relatively sharply downwardly inclined orientation. Preferably, the guide member 9 is positioned relative to the nips 10 such that the angle of the web 1 as it enters the nip with respect to the plane defined by the plurality of pins 12 is in the range of between 30 to 60 degrees.

The tenter frame also includes a longitudinal belt 15, driven by a belt pulley 16, for supporting the web 1 during its transport by the endless belts of the belt assemblies 13.

The guide member 9 can be held in a non-moving disposition relative to the oncoming web 1. In one modification of the preferred embodiment of the present invention, the guide member 9 is a roller adapted to rotate about its axial length to minimize rubbing problems between the guide member and the web 1 and, to this end, the guide member 9 can additionally be driven by a drive pulley fixedly mounted thereto and drivingly coupled to the belt pulley 16 by a drive chain 17. This arrangement allows the guide member 9 to rotate in synchronization with the feed of the web 1.

In the preferred embodiment, the guide member 9 is supported by a pair of swivel support members 18, each coupled to a respective belt assembly 13 for swiveling movement thereon and slidingly coupled to the guide member 9. Additionally, the guide member 9 is provided with a stop 19 on each axial end to ensure that the guide member maintains its side-to-side orientation with respect to the web 1.

The guide assembly of the present invention thus ensures that the web 1, across its entire width, enters the nips 10 in a relatively non-sagging disposition while eliminating the need to adjust the guide member frame in response to the variations in the distance between the feed roller 6 and the nips 10.

The guide assembly of the present invention operates as follows. The web 1 is trained around the rollers 3, 4 and 5 by operation of the feed roller 6, passes around the feed roller and is subsequently fed through the fingers 8. The web then passes over the guide member 9 which orients the web for proper entry into the nips 10. In fact, some sagging in the web is allowable as it travels between the feed roller 6 and the guide member 9 since the guide member 9 ensures that the web enters the nips without any detrimental sagging.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. In a tenter frame for drying a web of textile fabric fed along a feed path by a feed roller through edge straightening fingers to a pair of spaced apart belt assemblies with endless belts having vertical pins on which the edges of the web are impaled by rollers cooperating therewith at a nip below the height of the straightening fingers, an apparatus comprising:

means for guiding the traveling web at a relatively steep angle into the nip including a pair of swivel supports each movably supported on one of the belt assemblies and a guide member supported on said swivel supports, said guide member being positioned generally transversely to the feed path between the straightening fingers and the nip and at substantially the same height as the straightening fingers.

2. In a tenter frame, an apparatus according to claim 1 and characterized further in that said guide member is a roller rotatable about its axial length and said guiding means includes means for rotating said roller member in synchronization with the feed of the web.

3. In a tenter frame, an apparatus according to claim 1 and characterized further in that said guide member is positioned relative to the nip such that the web enters the nip at an angle in the range of 30 to 60 degrees.

* * * * *